US008375928B1

(12) United States Patent
Bednar et al.

(10) Patent No.: US 8,375,928 B1
(45) Date of Patent: Feb. 19, 2013

(54) SLIP CLUTCH

(75) Inventors: Richard L. Bednar, Munroe Falls, OH (US); Michael J. Shaffer, Mogadore, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 289 days.

(21) Appl. No.: 12/813,634

(22) Filed: Jun. 11, 2010

(51) Int. Cl.
*F41B 5/12* (2006.01)

(52) U.S. Cl. ..... 124/25

(58) Field of Classification Search ..... 124/25
See application file for complete search history.

(56) References Cited

U.S. PATENT DOCUMENTS 5,553,596 A 9/1996 Bednar
5,598,829 A 2/1997 Bednar
5,649,520 A 7/1997 Bednar
5,987,724 A 11/1999 Kleman
6,095,128 A 8/2000 Bednar
6,286,496 B1 9/2001 Bednar
6,874,491 B2 4/2005 Bednar
6,913,007 B2 7/2005 Bednar
7,100,590 B2 * 9/2006 Chang ..... 124/25
7,784,453 B1 * 8/2010 Yehle ..... 124/25
2009/0277435 A1 * 11/2009 Pestrue ..... 124/25
2010/0170488 A1 * 7/2010 Rasor et al. ..... 124/25

OTHER PUBLICATIONS

TenPoint Owner's Instruction Manual (Copyright 2006 TenPoint Crossbow technologies).

* cited by examiner

*Primary Examiner* — John Ricci
(74) *Attorney, Agent, or Firm* — Brouse McDowell; Stephen J. Preutti

(57) ABSTRACT

A bowstring drawing mechanism for drawing and controllably releasing a crossbow bowstring comprises a clutch mechanism. The clutch mechanism protects the bowstring drawing mechanism from damage caused by over-cranking and allows the user to controllably release the bowstring from the drawn position.

9 Claims, 9 Drawing Sheets

SLIP CLUTCH

I. BACKGROUND

A. Field of Invention

This invention pertains to the art of methods and apparatuses regarding crossbow drawing mechanisms and more specifically to methods and apparatuses regarding crossbow drawing mechanisms which utilize a clutch device for preventing damage to the crossbow drawing mechanism that may occur from attempts to overdraw the crossbow.

B. Description of the Related Art

It is known in the art for archery devices to include a bow having two outwardly extending arms and a bowstring strung between the ends of the outwardly extending arms. Conventionally, in order to propel or "fire" a projectile, such as an arrow, from the crossbow, the user grasps the bow in approximately the center between the two outwardly extending arms and pulls back or "draws" the bowstring with one hand while at the same time pushing the bow away with the other hand Drawing the bowstring requires a certain amount of strength and can, over time, take a physical toll on the user's arms. The amount of force needed to draw a given bow is normally measured in pounds and is known as the "draw weight" of a bow. Upon release of the bowstring from this "drawn" position, potential energy in the bowstring is imparted upon the projectile and the projectile is propelled or fired.

It is known to increase the speed and accuracy at which a projectile is propelled or fired from the crossbow by increasing the draw weight or the stiffness of the outwardly extending bow arms. However, an increase in the draw weight directly results in an increase in the amount of effort a user must exert to pull or draw the bowstring into position for firing. Modern crossbows can have bowstring pull weights of 150 pounds or more. It is readily apparent that with high pull weights, even operating a crossbow could be difficult, if not impossible, for many users having limited physical strength. This is particularly true for target practice or other situations where the crossbow may be drawn numerous times.

Recently, crossbows include devices for assisting the user in drawing the crossbow. For example, some crossbows include a stirrup bracket mounted on one end of the crossbow. In such crossbows, the user places the stirrup bracket onto the ground and places a foot in the stirrup bracket. By applying the user's body weight to the grounded stirrup bracket, the user can pull up or draw the crossbow bowstring into the "cocked" position. Although helpful, this provides only limited advantage. It is known to provide a leverage type cocking device to a crossbow. These crossbows typically comprise an arm which is pivoted to pull or push the crossbow bowstring into the cocked position. Additionally, it is known to utilize pneumatic or fluid actuated pistons to cock the crossbow bowstring into position for firing. Still other crossbows utilize ratchet or pulley arrangements mounted to the frame of the crossbow.

Although these methods work well for their intended purpose, several disadvantages exist. A significant problem relating to the cocking of a crossbow bowstring, whether performed manually or by means of a bowstring drawing mechanism, is found in properly withdrawing the bowstring relative to the outwardly extending limbs of the crossbow. A properly drawn bowstring should impart an equalized force to the projectile or arrow positioned therein when the bowstring is release from the crossbow trigger mechanism. This balancing of forces imparted on the bowstring by means of the crossbow limbs is particularly important for shooting accuracy in using the crossbow as well as for safety of use. Additionally, although these known systems attempt to simplify the bowstring cocking procedure, typically, they add complexity or cost, or are cumbersome to handle and use effectively.

To address the disadvantages listed above, crossbow bowstring drawing mechanisms, such as the one disclosed in U.S. Pat. No. 6,095,128 titled Crossbow Bowstring Drawing Mechanisms, which is herein incorporated by reference, have been developed. Known crossbow drawing mechanisms can be integrated into or secured in the crossbow stock member and provide a straight and balanced draw to the crossbow bowstring to cock the crossbow. The crossbow drawing mechanism can be either manually operated or motorized. The crossbow drawing mechanisms utilizes a source of rotational power such as a hand crank, power screwdriver, or an electric motor and a bowstring engaging device, commonly referred to as a claw member, to draw the bowstring.

Typically, to remove a bowstring engaging device 400 of a bowstring drawing mechanism 410 from a storage position, shown in FIG. 7, a user must disengage a safety lever 401, lift the bowstring engaging device 400 from the storage position, and then connect the bowstring engaging device 400 to the bowstring 403, as shown in FIG. 8. Commonly, the draw cord 402 of the bowstring engaging device 400 is under tension while the bowstring engaging device 400 is in the storage position. Therefore, to properly disengage the safety lever 401, the tension in the draw cord 402 must be relieved. The safety lever 401 may prevent a drive shaft 404 from rotating in a first direction while allowing the drive shaft 404 to rotate in a second direction. The tension in the draw cord 402 can be relieved by applying a slight amount of pressure to cause the drive shaft 404 to rotate in the second direction as if attempting to increase the tension applied to the draw cord 402. A hand crank 405 may be used to apply the slight amount of pressure to the drive shaft 404 necessary to allow the transfer of the retention force away from the safety lever 401 thereby allowing the safety lever 401 to be properly disengaged, as shown in FIG. 9.

Commonly, to properly draw the bowstring 403, a second safety device 406 must be disengaged or moved to the "Fire" position. With the second safety device 406 disengaged, the drive shaft 404 is then rotated thereby causing the bowstring engaging device 400 and the bowstring 403 to be retracted and drawn respectively. The user may determine that the crossbow is cocked when the second safety device 406 is caused to be engaged or moved to the "Safe" position and when the string latch of the trigger assembly 407 is heard engaging the bowstring 405. Typically, once the bowstring engaging device 400 has drawn the bowstring 403 and the crossbow is cocked, the bowstring engaging device 400 retains the bowstring 403 under tension rather than the string latch of the trigger assembly 407. To relieve the tension applied to the bowstring engaging device 400, the drive shaft 404 must be slightly rotated in the second direction, thereby allowing the safety lever 401 to be disengaged so that the bowstring engaging device 400 can be moved forward, towards the string latch, such that the tension from the bowstring 403 is now applied to the string latch. The bowstring engaging mechanism 400 may now be slid out of the trigger assembly 407 and returned to the storage position. The drive shaft 404 may then be rotated in the second direction to retract any excess draw cord 402 and to secure the bowstring engaging mechanism 400 in the storage position by applying tension to the bowstring engaging device 400.

A user may significantly damage a crossbow drawing mechanism by "over-cranking" or excessively rotating the drive shaft when attempting to disengage the safety lever.

Over-cranking the crossbow drawing mechanism may damage the crossbow and/or over-stress the draw cord. The crossbow drawing mechanism typically utilizes a gear-reduction mechanism that allows the user to exert a minimal amount of force in drawing the crossbow. Therefore, over-cranking combined with the gear-reduction mechanism can result in the trigger mechanism being forcibly lifted from its mounted position in the barrel of the crossbow and/or the draw cords being broken. What is needed then is a crossbow drawing mechanism that provides a straight and balanced draw to the crossbow bowstring to cock the crossbow while preventing the over-cranking of the crossbow drawing mechanism.

II. SUMMARY

According to one embodiment of the invention, a method for un-cocking a crossbow includes the steps of:

(a) providing a crossbow having a stock member, a bow portion, a bowstring, and a trigger assembly, wherein the bowstring is selectively positionable into a cocked position and an un-cocked position;

(b) providing a bowstring drawing mechanism operatively connected to the stock member for selectively moving the bowstring between the cocked position and the un-cocked position comprising a claw member for selectively engaging the bowstring; a drive shaft; a ratchet gear assembly that permits the rotation of the drive shaft in a first rotational direction and can be engaged to selectively prohibit the rotation of the drive shaft in a second rotational direction; a drive gear assembly for translating the rotational motion of the drive shaft into the linear motion of the claw member; and a clutch mechanism for allowing the controlled release of the bowstring from the cocked position and for preventing the over-cranking of the bowstring drawing mechanism;

(c) rotating the drive shaft in the first rotational direction to move the bowstring from the un-cocked position to the cocked position, wherein the rotation of the drive shaft in the first rotational direction causes a pinion shaft to be rotated in the second rotational direction and the claw member is operatively coupled to the pinion shaft;

(d) engaging the ratchet gear assembly to prohibit the rotation of the drive shaft in the second rotational direction;

(e) engaging the bowstring with the claw member;

(f) releasing the bowstring from the trigger assembly, wherein the bowstring drawing mechanism substantially prevents the movement of the bowstring from the cocked position to the un-cocked position;

(g) rotating the pinion shaft in the first rotational direction to move the bowstring from the cocked position to the un-cocked position, wherein the clutch mechanism is operatively coupled to the pinion shaft and allows the pinion shaft to rotate in the second rotational direction independent of the drive shaft.

According to another embodiment of the invention, the step of rotating the drive shaft in the first rotational direction to move the bowstring from the un-cocked position to the cocked position, wherein the rotation of the drive shaft in the first rotational direction causes a pinion shaft to be rotated in the second rotational direction and the claw member is operatively coupled to the pinion shaft, may further include the steps of:

engaging a first driving head formed at a first end of the drive shaft; The step of rotating the pinion shaft in the first rotational direction to move the bowstring from the cocked position to the un-cocked position, wherein the clutch mechanism is operatively coupled to the pinion shaft and allows the pinion shaft to rotate in the second rotational direction independent of the drive shaft, may further comprise the step of:

engaging a second driving head formed at a first end of the pinion shaft.

According to another embodiment of the invention, the step of rotating the drive shaft in the first rotational direction to move the bowstring from the un-cocked position to the cocked position, wherein the rotation of the drive shaft in the first rotational direction causes a pinion shaft to be rotated in the second rotational direction and the claw member is operatively coupled to the pinion shaft, may further include the steps of:

applying a first torque to the drive shaft, wherein the application of the first torque causes the linear movement of the claw member; and, applying a second torque to the drive shaft, wherein the second torque is greater than the first torque and the application of the second torque causes the drive shaft to be rotated independent of the pinion shaft.

According to another embodiment of the invention, the step of providing a bowstring drawing mechanism operatively connected to the stock member for selectively moving the bowstring between the cocked position and the un-cocked position comprising a claw member for selectively engaging the bowstring; a drive shaft; a ratchet gear assembly that permits the rotation of the drive shaft in a first rotational direction and can be engaged to selectively prohibit the rotation of the drive shaft in a second rotational direction; a drive gear assembly for translating the rotational motion of the drive shaft into the linear motion of the claw member; and a clutch mechanism for allowing the controlled release of the bowstring from the cocked position and for preventing the over-cranking of the bowstring drawing mechanism, may include the steps of:

providing a housing connected to a tailstock portion of the stock member;

extending a first drive head formed at the end of the drive shaft through a first aperture formed in the housing; and, extending a second drive head formed at the end of the pinion shaft through a second aperture formed in the housing.

According to another embodiment of the invention, the step of rotating the drive shaft in the first rotational direction to move the bowstring from the un-cocked position to the cocked position, wherein the rotation of the drive shaft in the first rotational direction causes a pinion shaft to be rotated in the second rotational direction and the claw member is operatively coupled to the pinion shaft, may further include the steps of:

accessing a first drive head formed at the end of the drive shaft through a first aperture formed in a housing attached to the stock member;

The step of rotating the pinion shaft in the first rotational direction to move the bowstring from the cocked position to the un-cocked position, wherein the clutch mechanism is operatively coupled to the pinion shaft and allows the pinion shaft to rotate in the second rotational direction independent of the drive shaft, may further comprise the step of:

accessing a second drive head formed at the end of the pinion shaft through a second aperture formed in the housing.

According to one embodiment of the invention, a crossbow has a stock member, a bow portion, a trigger assembly, and a bowstring drawing mechanism. The stock member has a tailstock and a barrel. The bow portion has a first limb member, a second limb member, and a bowstring. The first limb member and the second limb member extend transversely on opposite sides from the stock member and the bowstring extends between the first limb member and the second limb member.

The trigger assembly is associated with the stock member for selectively holding and releasing the bowstring. The bowstring drawing mechanism has a drive shaft, a ratchet gear assembly, a drive gear assembly, a clutch mechanism, and a drawing assembly. The ratchet gear assembly is carried on the drive shaft and permits the rotation of the drive shaft in a first rotational direction and selectively prohibits the rotation of the drive shaft in a second rotational direction. The drive gear assembly is operatively coupled to the drive shaft. A drive gear is carried on the drive shaft and the drive gear is meshingly engaged with a spur gear that is operatively coupled to a pinion shaft. The rotation of the drive shaft in the first rotational direction causes the rotation of the spur gear in the second rotational direction. The clutch mechanism is carried on the pinion shaft and is operatively coupled to the spur gear. The drawing assembly is operatively connected between the pinion shaft and the bowstring. The drawing assembly can selectively engage the bowstring to move the bowstring between a cocked position and an un-cocked position. The clutch mechanism permits the pinion shaft to be rotated in the first direction to controllably return the bowstring to the un-cocked position and prevents the over-cranking of the bowstring drawing mechanism. Optionally, the crossbow may include an integrated power supply. The integrated power supply may be positioned within the tailstock of the crossbow. In one embodiment, the integrated power supply may be a battery.

According to another embodiment of the invention, the crossbow may additionally include a housing attached to the tailstock having a first aperture and a second aperture, wherein a first drive head formed at the end of the drive shaft extends through the first aperture and a second drive head formed at the end of the pinion shaft extends through the second aperture.

According to one embodiment of the invention, a bowstring drawing mechanism has a bowstring drawing assembly, a drive shaft, a ratchet gear assembly, a drive gear assembly, and a clutch mechanism. The bowstring drawing assembly has a claw member for selectively engaging a bowstring of an associated crossbow. The ratchet gear assembly is operatively coupled to the drive shaft. The ratchet gear assembly permits the rotation of the drive shaft in a first rotational direction and selectively prohibits the rotation of the drive shaft in a second rotational direction. The drive gear assembly translates a rotational motion of the drive shaft into a linear motion of the claw member to cause the bowstring to move between an un-cocked position and a cocked position. The clutch mechanism is operatively connected to a pinion shaft of the drive gear assembly. The clutch member protects the drawing mechanism from damage caused by over-cranking and allows the bowstring to be controllably released from the cocked position.

According to another embodiment of the invention, the drive gear assembly of the bowstring drawing mechanism may further include a drive gear and a spur gear. The drive gear is operatively coupled to the drive shaft. The rotation of the drive shaft in the first direction causes the rotation of the drive gear in the first direction. The rotation of the drive shaft in the second direction causes the rotation of the drive gear in the second direction. The spur gear is operatively coupled to the pinion shaft. The rotation of the drive gear in the first direction causes the rotation of the spur gear in the second direction. The clutch mechanism of the bowstring drawing mechanism further includes a spool, a spring washer, and a clutch. The spool is pinned to the pinion shaft and carries the spur gear, the clutch and the spring washer. The spur gear is positioned between the spring washer and the clutch. The spring washer urges the spur gear into contact with the clutch. The rotation of the spur gear can cause the rotation of the clutch and the rotation of the clutch can cause the rotation of the spur gear.

According to another embodiment of the invention, the bowstring drawing mechanism may also include a housing having a first aperture and a second aperture, wherein a first drive head formed at the end of the drive shaft extends through the first aperture and a second drive head formed at the end of the pinion shaft extends through the second aperture.

One advantage of this invention is that it prevents a user from over-cranking the crossbow drawing mechanism.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DETAILED DESCRIPTION

Figure 1:
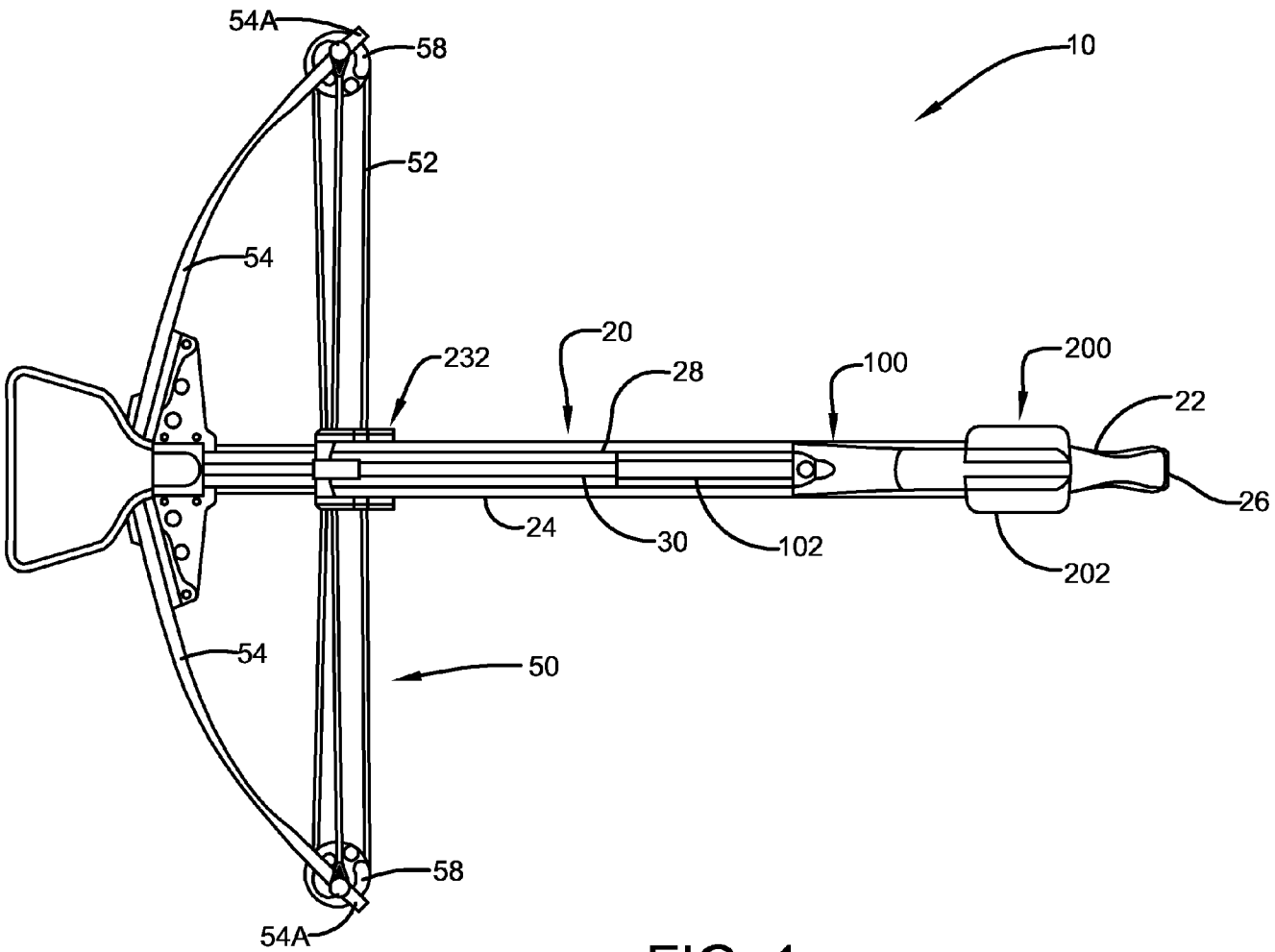
FIG. 1 shows a perspective top view of a crossbow having a bowstring drawing mechanism according to one embodiment of the invention.

Referring now to the drawings wherein the showings are for purposes of illustrating embodiments of the invention only and not for purposes of limiting the same, FIG. 1 shows a crossbow 10 comprising a bowstring drawing mechanism 200 that protects against damage caused by over-cranking and allows for the controlled release of the bowstring according to one embodiment of the invention. It should be understood that in accordance with the present invention, the bowstring drawing mechanism 200 may be used with any type of crossbow, and no limitations with regard to the configuration of the crossbow generally exist. In one embodiment of the invention, the bowstring drawing mechanism 200 may be retrofit with an existing crossbow 10. In another embodiment, the bowstring drawing mechanism 200 may be manufactured as part of a crossbow 10. In both embodiments, the bowstring drawing mechanism 200 may be integrated with the crossbow 10 so as to be convenient and easily used, without hindering the function and operability of the crossbow 10.

Figure 2:
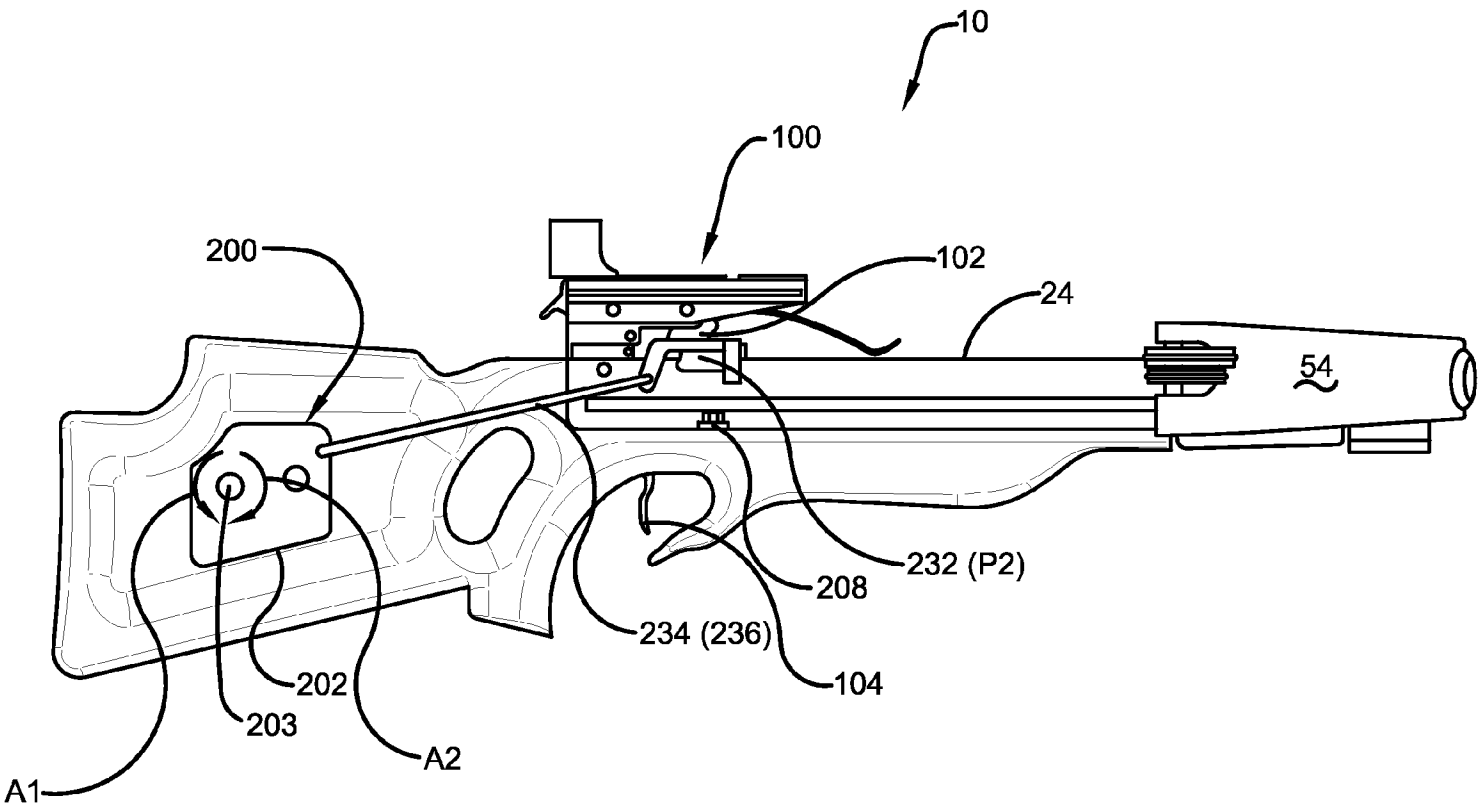
FIG. 2 shows a perspective side view of a crossbow. in the un-cocked or relaxed position. having a bowstring drawing mechanism according to one embodiment of the invention.
Figure 3:
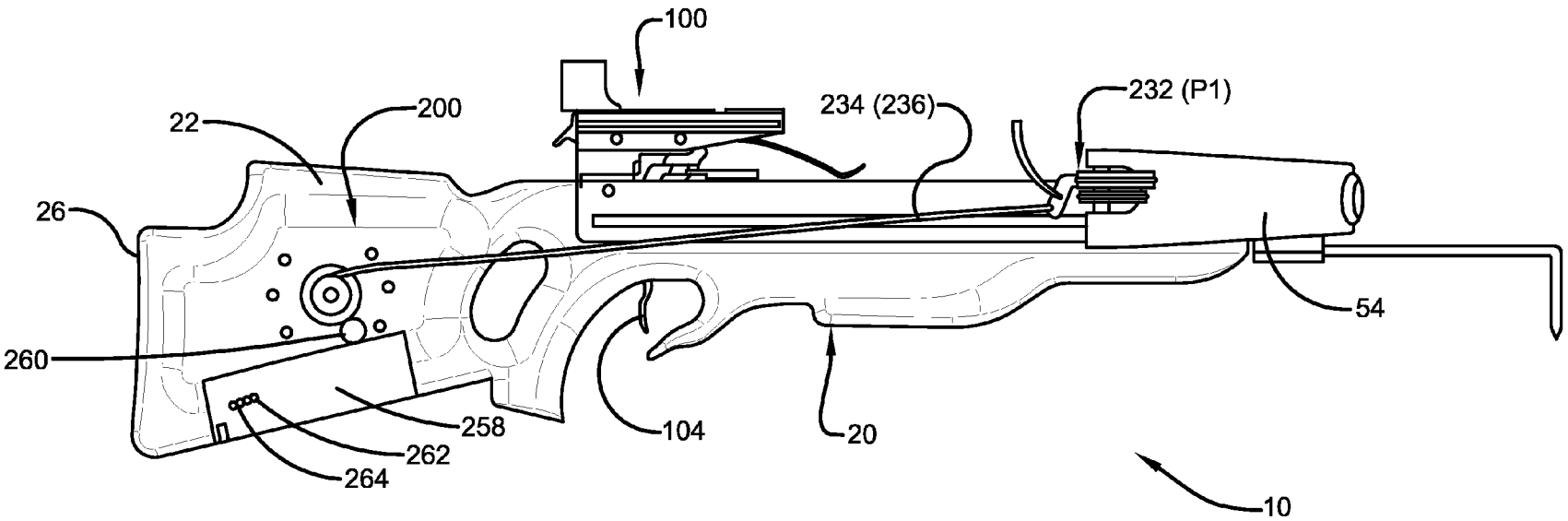
FIG. 3 shows a perspective side view of a crossbow, in the cocked or drawn position, having a bowstring drawing mechanism according to one embodiment of the invention.

With reference now to FIGS. 1, 2, and 3, the crossbow 10 may generally comprise the bowstring drawing mechanism 200, a stock member 20, a bow portion 50, and a trigger assembly 100. The trigger assembly 100 may be associated with the stock member 20 for selectively holding and releasing a bowstring 52. The bow portion 50 may comprise two outwardly extending limb members 54 that extend transversely on opposite sides from the stock member 20. The bowstring 52 may be selectively positionable into a cocked or drawn position P2, as shown in FIG. 3, and an un-cocked or relaxed position P1, as shown in FIG. 2. The bowstring 52 may be strung between the distal ends 54*a* of the limb members 54 such that as the bowstring 52 is drawn and held by the trigger assembly 100 in the cocked or drawn position, the limb members 54 are tensioned, thereby storing energy, that is released upon release of the bowstring 52 from the trigger assembly 100, to propel an arrow or other projectile. The stock member 20 may generally comprise a rear portion or tailstock 22 and a forestock or barrel 24. The tailstock 22 may comprise an integrally formed butt portion 26 that is normally positioned against the user's shoulder when the crossbow 10 is being aimed or fired. The barrel 24 may comprise a hollow, extruded member that provides added structural integrity to the crossbow 10 that is normally held by the user when the crossbow 10 is being aimed or fired. In one embodiment, the barrel 24 may comprise a separate member formed of a strong, lightweight material, such as aluminum. In another embodiment, the barrel 24 may be integral to the tailstock 22. The barrel 24 may comprise an upper surface 28 and an arrow guide or channel 30. The upper surface 28 may comprise a flat surface on which the bowstring 52 may slide in operation of the crossbow 10. The channel 30 may be a groove formed in the upper surface 28 of the barrel 24 that receives at least a portion of the arrow or projectile to be fired from the crossbow 10. For example, the channel 30 may receive a member of an arrow's fletching, which is commonly a plastic vane or feather, and acts as a guide to direct the arrow from the crossbow 10. While the arrow is being fired from the crossbow 10, the member of the arrow's fletching disposed within the channel 30 may also serve to guide the arrow towards the terminal end of the barrel 24.

With continued reference now to FIGS. 1, 2, and 3, the trigger assembly 100 may be associated with the stock member 20 and may comprise any type of trigger assembly suitable for selectively holding and releasing the bowstring 52 chosen with sound judgment by a person of ordinary skill in the art. The trigger assembly 100 generally includes a guide 102 and a user-actuated trigger lever 104. The bowstring 52 may be retracted to and held within the guide 102 in the drawn position by a sear or pivotal string latch, not shown. The trigger lever 104 can be pulled to selectively release the sear, not shown, thereby causing the bowstring 52 to be released to propel an arrow positioned on the upper surface 28 of the barrel 24.

With reference now to FIGS. 2-6, the bowstring drawing mechanism 200 may comprise a housing 202, a drive shaft 204, a ratchet gear assembly 215, a drive gear assembly 206, the clutch mechanism 300, and a drawing assembly 208. The housing 202 may be secured to or comprise an integral part of the tailstock 22. In one embodiment, the bowstring drawing mechanism 200 may be integrated into the tailstock 22, with the tailstock 22 forming the housing 202. In another embodiment, the housing 202 may comprise a mounting plate 210. The mounting plate 210 may be adapted to mount the bowstring drawing mechanism 200 in association with the tailstock 22 by means of screws or fasteners. The housing 202 may be mounted within a cavity formed in the tailstock 22 suitable to accept the bowstring drawing mechanism 200.

Figure 4:
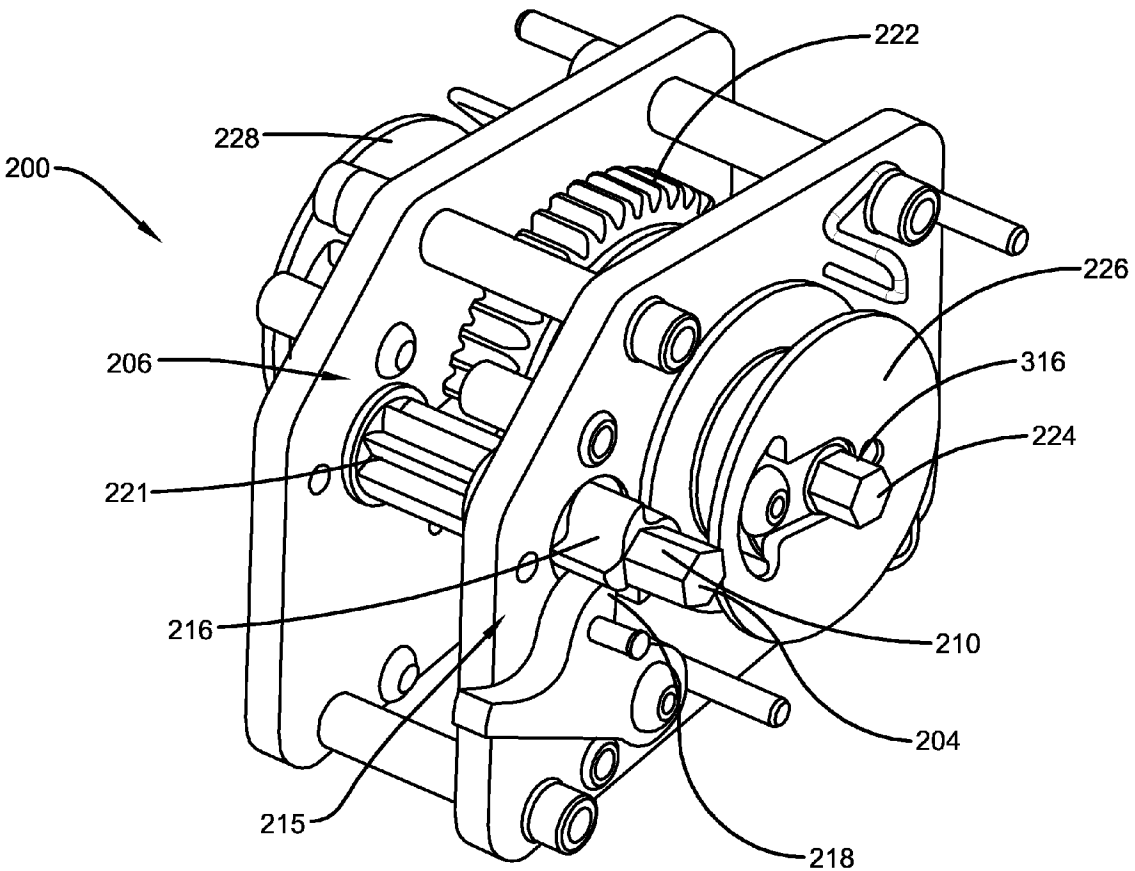
FIG. 4 shows a perspective view of a bowstring drawing mechanism according to one embodiment of the invention.
Figure 7:
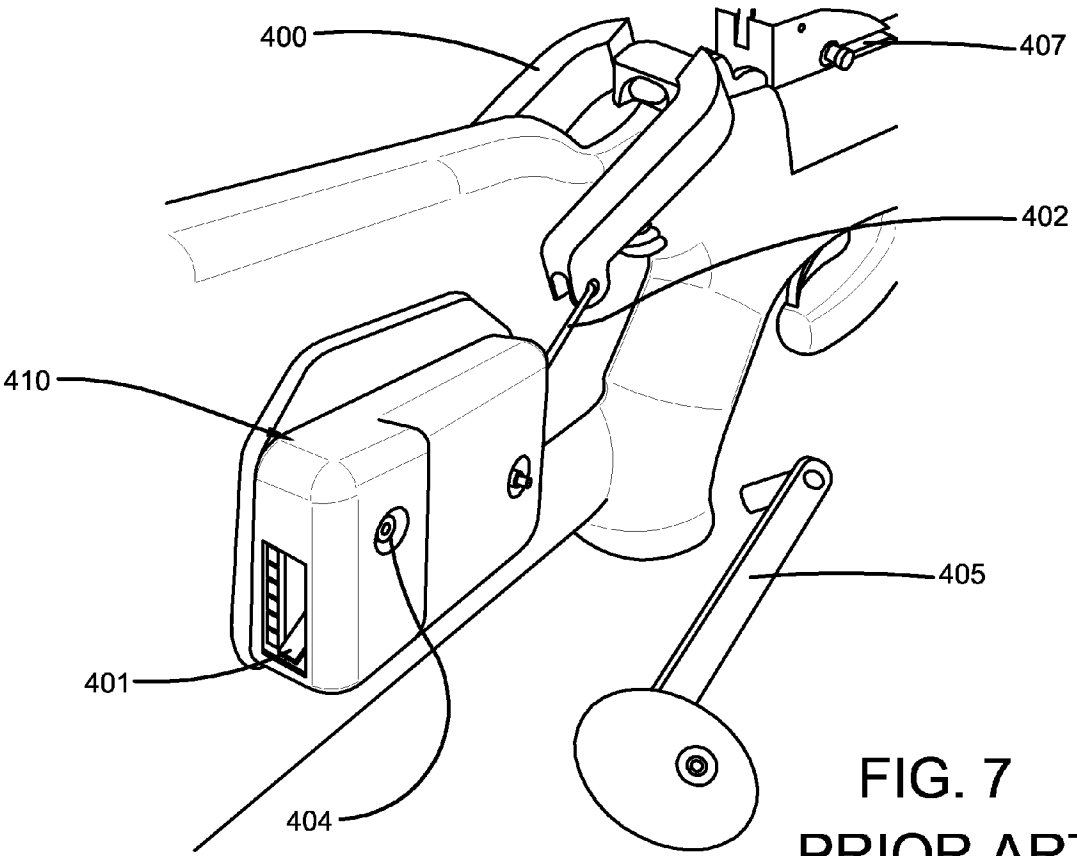
FIG. 7 PRIOR ART
FIG. 7 shows a partial perspective view of a prior art bowstring drawing mechanism and hand crank.
Figure 8:
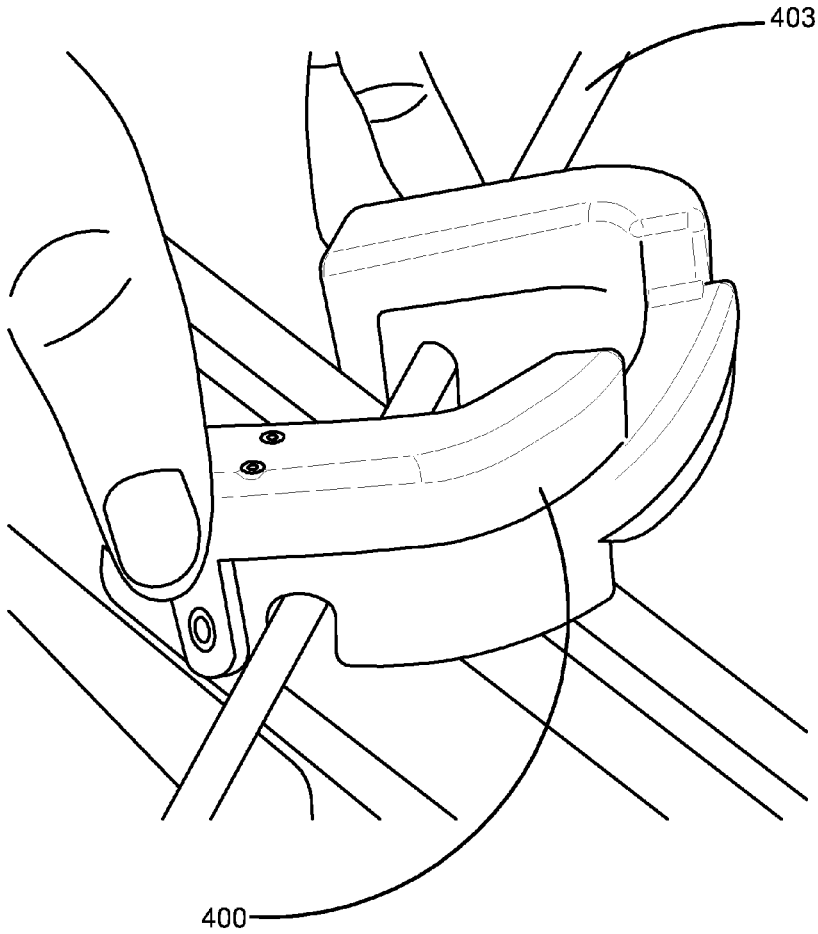
FIG. 8 PRIOR ART
FIG. 8 shows a claw member of a prior art bowstring drawing mechanism engaging a bowstring.
Figure 9:
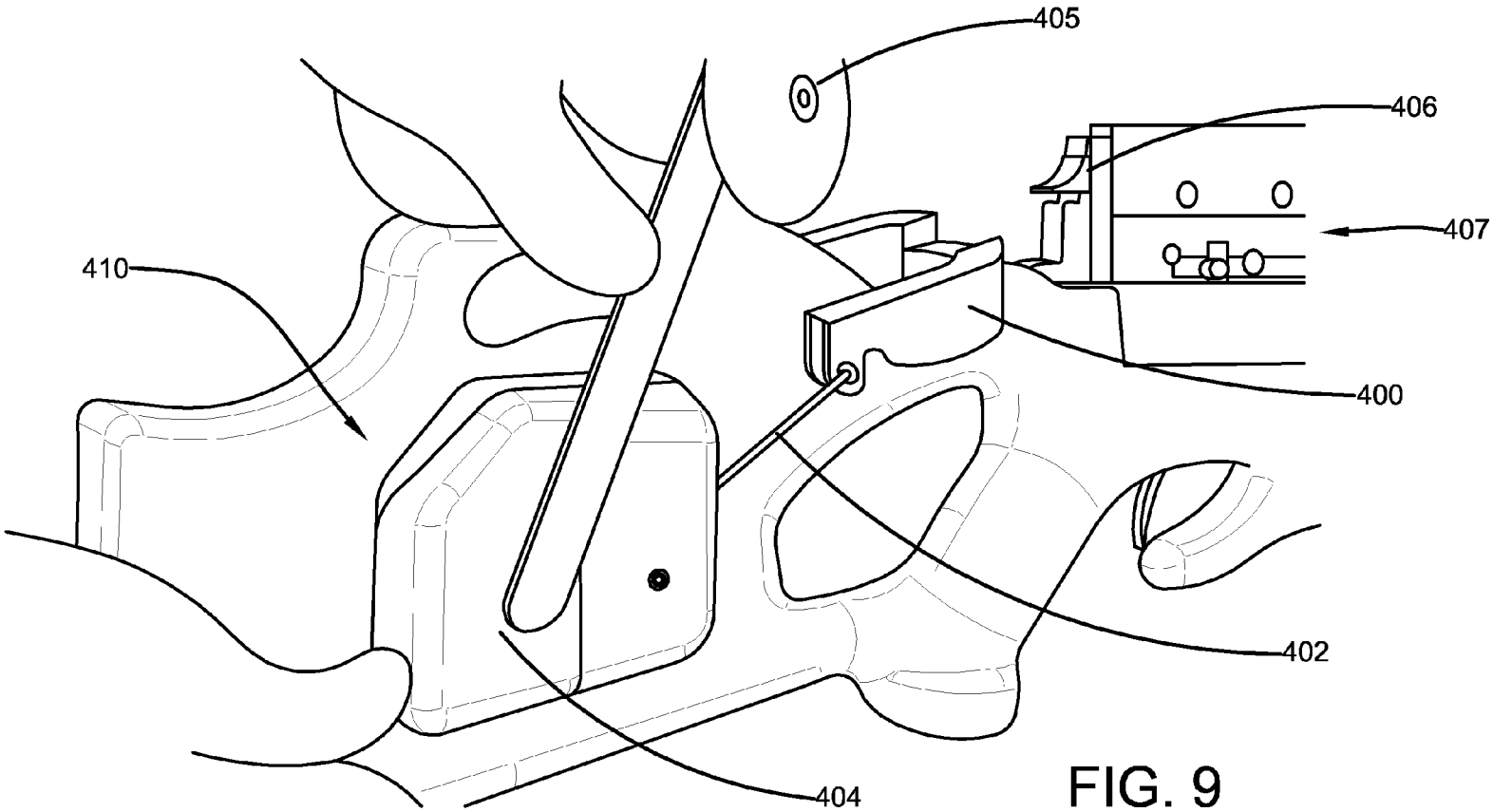
FIG. 9 PRIOR ART
FIG. 9 shows a user releasing the bowstring drawing mechanism shown in FIG. 8.

With reference now to FIGS. 2, 4, and 7, the drive shaft 204 may be rotationally mounted within the housing 202. In one embodiment, the drive shaft 24 may be positioned within a bushing, not shown, to allow rotation of the drive shaft 204 with respect to other components. The drive shaft 204 may comprise a driving head 210 formed at one end. The driving head 210 may be accessible through an aperture 203 formed in the housing 202. In another embodiment, the driving head 210 may extend through the aperture 203 formed in the housing 202 to a position external to the housing 202. The driving head 210 may comprise a hex head configuration, a slotted head configuration, or a similar design that is suitable to be engaged and rotationally driven by an external power source. In one embodiment, the driving head 210 may be magnetized to thereby hold a hand crank 405, shown in FIG. 7, into operative engagement with the driving head 210. In another embodiment, the driving head 210 may be designed to be driven by a power driving source (not shown) such as a power drill, power screwdriver, or other source of external rotational power suitable for engaging and rotating the driving head 210.

With reference now to FIGS. 2 and 4, in one embodiment, the ratchet gear assembly 215 may be carried on the drive shaft 204. The ratchet gear assembly 215 may permit rotation of the drive shaft 204 in a first rotational direction, shown by arrow A1 in FIG. 2, but prohibit the rotation of the drive shaft 204 in a second rotational direction, shown by arrow A2 in FIG. 2. The ratchet gear assembly 215 may comprise a ratchet gear 216 and a pawl 218. In one embodiment, a biasing means, such as a pawl spring, not shown, may resiliently bias the pawl 218 to a position between adjacent gear teeth of the ratchet gear 216, as shown in FIG. 4. At least a portion of the pawl 218 may extend to a position external to the housing 202 thereby allowing a user to selectively disengage the pawl 218 from the ratchet gear 216 in order to allow the rotation of the drive shaft 204 in the second rotational direction. The pawl spring, not shown, or other biasing means, may cause the reengagement of the pawl 218 upon release of the pawl 218 by the user.

With reference now to FIGS. 1, 2, 4, and 7, the drive gear assembly 206 may comprise a drive gear 221, a spur gear 222, a pinion shaft 224, a first hub 226, and a second hub 228. The drive gear 221 may be carried on the drive shaft 204 and operatively coupled with the ratchet gear assembly 215. The pinion shaft 224 may be rotatably supported in a pair of bushings, not shown, to allow the rotation of the pinion shaft 224 with respect to other components. The spur gear 222 may be operatively coupled to the pinion shaft 224. The gear teeth of the drive gear 221 may be meshingly engaged with the gear teeth of the spur gear 222 such that the rotation of the drive shaft 204 in the first rotational direction A1 can cause the rotation of the spur gear 222 in the second rotational direction A2. The spur gear 222, in relation to the drive gear 221, may provide a predetermined gear ratio that allows rotation of the pinion shaft 224 with less torque, and therefore allows an external rotational source such as the hand crank 405, power drill or the like to be easily used to retract the bowstring 52. The first and second hubs 226, 228 may be operatively connected to opposite ends of the pinion shaft 224 and may rotate upon the rotation of the pinion shaft 224.

Figure 5:
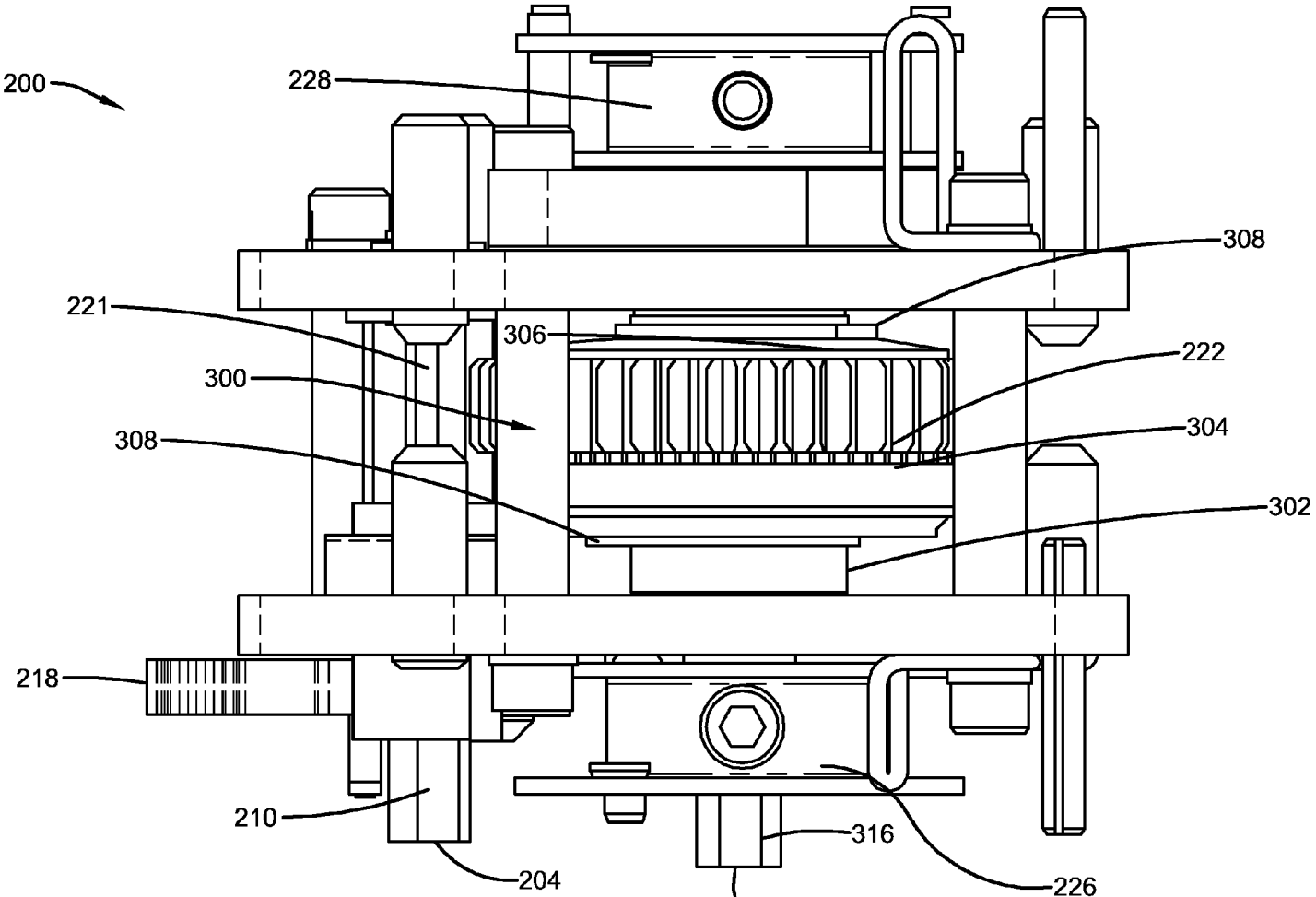
FIG. 5 shows a top perspective view of the bowstring drawing mechanism shown in FIG. 4.
Figure 6:
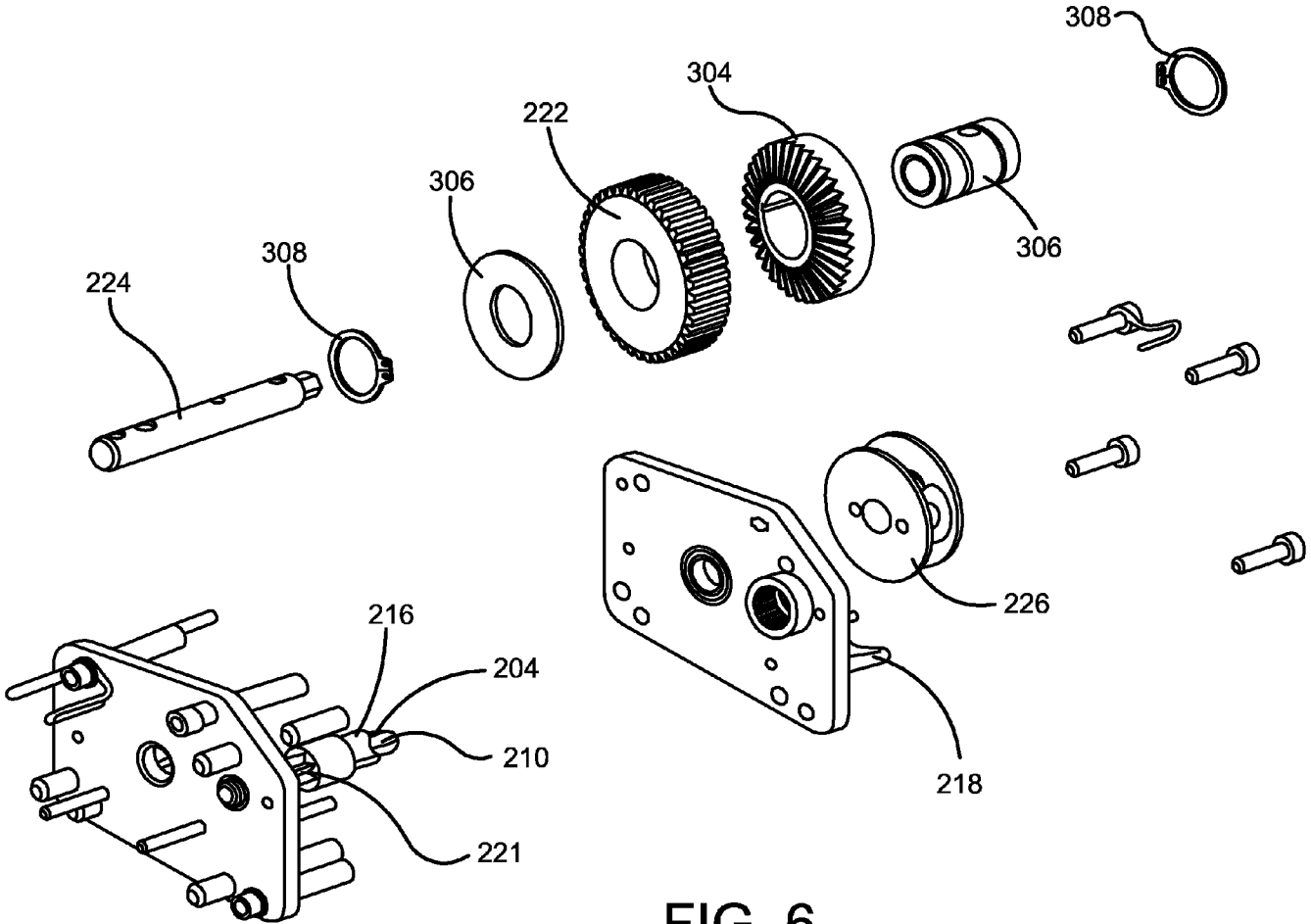
FIG. 6 shows a partial assembly view of a crossbow drawing mechanism according to one embodiment of the invention.

With reference now to FIGS. 4-6, the clutch mechanism 300 may be operatively coupled to the pinion shaft 224 and may comprise a slip clutch that at least partially controls the rotation of the pinion shaft 224 and/or the drive shaft 204. In one embodiment, the clutch mechanism 300 may comprise a spool 302, a clutch 304, and a spring washer 306. The spool 302 may be pinned to the pinion shaft 224 and may carry the clutch 304, the spur gear 222, and the spring washer 306. The spur gear 222 may be positioned between the spring washer 306 and the clutch 304. The clutch 304 may be operatively coupled to the pinion shaft 224 such that the rotation of the clutch 304 causes the rotation of the pinion shaft 224 and the rotation of the pinion shaft 224 causes the rotation of the clutch 304. The spring washer 306 may comprise a device that exerts a predetermined amount of force against the spur gear 222 thereby urging the face of the spur gear 222 against the face of the clutch 304 such that the rotation of the spur gear 222 can cause the rotation of the clutch 304 thereby causing the rotation of the pinion shaft 224. Upon the application of a predetermined amount of torque to the drive shaft 204, the force exerted on the spur gear 222 by the spring washer 306 may be insufficient to cause the rotation of the spur gear 222 to cause the rotation of the clutch 304 thereby allowing the spur gear 222 to rotate independent of the clutch 304. A pair of retaining rings 308 may prevent the axial movement of the spring washer 306, the spur gear 222 and the clutch 304 along the pinion shaft 224. In another embodiment, the clutch mechanism 300 may be carried on the drive shaft 204 and operatively coupled to the drive gear 221. The clutch mechanism 300 may be positioned anywhere within the bowstring drawing mechanism 200 to prevent the over-cranking of the bowstring drawing mechanism 200 chosen with sound judgment by a person of ordinary skill in the art.

With reference now to FIGS. 1, 2, and 4, the drawing assembly 208 may be utilized to engage the bowstring 52 when moving the bowstring 52 between the uncocked or relaxed position P1 and the cocked or drawn position P2. One example of a suitable drawing assembly is shown in U.S. Pat. No. 6,913,007, which is herein incorporated by reference. The drawing assembly 208 may comprise a claw member 232, a first cable portion 234, and a second cable portion 236. The drive gear assembly 206 may be utilized in conjunction with the drawing assembly 208 to translate the rotational movement of the drive shaft 204 into the longitudinal movement of the claw member 232 along the barrel 24. In one embodiment, the first cable portion 234 may be operatively coupled to and extend between the first hub 226 and the claw member 232 and the second cable portion 236 may be operatively coupled to and extend between the second hub 228 and the claw member 232. In another embodiment, the first cable portion 234 and the second cable portion 236 may comprise a single cable that extends into engagement with the claw member 232 and around both the first and second hubs 226, 228. The first and second cable portions 234, 236 may extend on opposed sides of the barrel 24. The rotation of the pinion shaft 224, and thus the first hub 226 and the second hub 228, in the second rotational direction A2, may cause the first cable portion 234 to wind around the first hub 226, and the second cable portion 236 to wind around the second hub 228. The rotation of the pinion shaft 224 may cause the first and second cable portions 234 and 236 to wind around the first and second hubs 226 and 228 such that the extent of each of the first and second cable portions 234 and 236 extending out from the trigger assembly 100 becomes progressively shorter at substantially the same rate. Similarly, the rotation of the pinion shaft 224 in the first rotational direction A1 may cause the first and second cable portions 234 and 236 to unwind from hubs 226 and 228 thereby causing the outwardly extending portion of each cable portion 234 and 236 to become progressively longer.

With continued reference now to FIGS. 1, 2, and 4, when rotating the drive shaft 204 to move the bowstring 52 from the un-cocked position P1 to the cocked position P2, the torque applied may be insufficient to overcome the force exerted by the spring washer 306 allowing the rotation of the spur gear 222 may cause the rotation of the clutch 304 and the pinion shaft 222 thereby causing the claw member 232 to be moved along the barrel 24. The claw member 232 may be designed to allow for balanced retraction of the bowstring 52 during operation of the bowstring drawing mechanism 200. Upon the bowstring 52 being moved to the cocked position P2, the claw member 232 may contact the guide 102 thereby preventing the further movement of the claw member 232 along the barrel 24. The continued rotation of the drive shaft 204 may cause a sufficient amount of torque to be transferred to the spur gear 222 to overcome the force exerted by the spring washer 306 thereby causing the spur gear 222 to rotate independent of the clutch 304. The rotation of the spur gear 222 independent of the clutch 304 may prevent the rotation of the pinion shaft 224 thereby preventing the over-cranking of the bowstring drawing mechanism 200.

With reference now to FIGS. 1, 2, 4, and 7, the bowstring drawing mechanism 200 may allow for the un-cocking of the crossbow 10 by permitting the controlled release of the bowstring 52 by the user. In one embodiment, the pinion shaft 224 may comprise a driving head 316 that extends through or may be accessed through an aperture in the housing 202. The driving head 316 may comprise substantially the same shape as the driving head 210 of the drive shaft 204. In one embodiment, the claw member 232 may be used to engage the bowstring 52 while the bowstring 52 is selectively retained by the trigger assembly 100 in the drawn position P2 in order to controllably release the bowstring 52. Upon release of the bowstring 52 from the trigger assembly 100 the force exerted by the bowstring 52 may be insufficient to cause the clutch 304, and therefore the pinion shaft 224, to rotate independent of the spur gear 222. The pawl 218 may be meshingly engaged with the gear teeth of the ratchet gear 216 thereby preventing the rotation of the spur gear 222 and the subsequent movement of the bowstring 52. Without disengaging the pawl 218, the driving head 316 may be rotated in the first rotational direction A1, for example, a user may utilize the hand crank 405, thereby applying a sufficient amount of torque to cause the clutch 304 to rotate independent of the spur gear 222. The rotation of the clutch 304 independent of the spur gear 222 and, therefore, the drive shaft 204, allows for the controlled release of the bowstring 52. The pawl 218 may remain engaged with the ratchet gear 216 and may act as a type of safety. For example, if the pawl 218 is disengaged, the force exerted by the bowstring 52 when released from the trigger assembly 100 is insufficient to cause the clutch 304 to rotate independent of the spur gear 222. Therefore, if not otherwise prevented, the bowstring 52 will be uncontrollably released, or dry fired, which may cause injury to the user or damage the crossbow 10.

With reference now to FIGS. 2-4, in one embodiment, the bowstring drawing mechanism 200 may comprise an integral rotational power source 258. In one embodiment, the power source 258 may comprise a battery integrated into the stock member 20. The integrated rotational power source 258 may comprise an intermediate gear 260 operatively coupled to the drive shaft 204. The actuation of the power source 258 may cause the intermediate gear 260 to be driven, which in turn may then cause the drive shaft 204 to be rotated. Alternatively, the power source 258 may be configured such that the actuation of the power source 258 may directly cause the rotation of the drive shaft 204. In one embodiment, the operation of the integrated rotational power source 258 may be controlled by a forward switch 262 and reverse switch 264 mounted on the stock member 20. The actuation of the forward switch 262 may allow the user to control the rotation of the drive shaft 204 thereby allowing the user to move the bowstring 52 from the un-cocked position P1 to the cocked position P2. The actuation of the reverse switch 264 may allow the user to control the rotation of the pinion shaft 224 thereby allowing the user to controllably release the bowstring 52 as described above. In another embodiment, the power source 258 may comprise a selectively removable battery and the operation of the bowstring drawing mechanism 200 may be controlled through the insertion and removal of the battery from the power source 258.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A crossbow comprising:

a stock member having a tailstock and a barrel;

a bow portion having a first limb member, a second limb member, and a bowstring, wherein the first limb member and the second limb member extend transversely on opposite sides from the stock member and the bowstring extends between the first limb member and the second limb member;

a trigger assembly associated with the stock member for selectively holding and releasing the bowstring a bowstring drawing mechanism comprising:

a drive shaft;

a ratchet gear assembly carried on the drive shaft that permits the rotation of the drive shaft in a first rotational direction and selectively prohibits the rotation of the drive shaft in a second rotational direction;

a drive gear assembly operatively coupled to the drive shaft, wherein a drive gear is carried on the drive shaft and the drive gear is meshingly engaged with a spur gear that is operatively coupled to a pinion shaft and the rotation of the drive shaft in the first rotational direction causes the rotation of the spur gear in the second rotational direction;

a clutch mechanism carried on the pinion shaft and operatively coupled to the spur gear;

a drawing assembly operatively connected between the pinion shaft and the bowstring, wherein the drawing assembly can selectively engage the bowstring to move the bowstring between a cocked position and an un-cocked position, wherein the clutch mechanism permits the pinion shaft to be rotated in the first direction to controllably return the bowstring to the relaxed position and prevents the over-cranking of the bowstring drawing mechanism.

2. The crossbow of claim 1, further comprising:

a housing attached to the tailstock having a first aperture and a second aperture, wherein a first drive head formed at the end of the drive shaft extends through the first aperture and a second drive head formed at the end of the pinion shaft extends through the second aperture.

3. The crossbow of claim 1, further comprising:

an integrated power supply.

4. The crossbow of claim 3, wherein the integrated power supply is positioned within the tailstock.

5. The crossbow of claim 3, wherein the integrated power supply comprises a battery.

6. A bowstring drawing mechanism comprising:

a bowstring drawing assembly having a claw member for selectively engaging a bowstring of an associated crossbow;

a drive shaft;

a ratchet gear assembly operatively coupled to the drive shaft, wherein the ratchet gear assembly permits the rotation of the drive shaft in a first rotational direction and selectively prohibits the rotation of the drive shaft in a second rotational direction;

a drive gear assembly that translates a rotational motion of the drive shaft into a linear motion of the claw member to cause the bowstring to move between an un-cocked position and a cocked position;

a clutch mechanism operatively connected to a pinion shaft of the drive gear assembly, wherein the clutch member protects the drawing mechanism from damage caused by over-cranking and allows the bowstring to be controllably released from the cocked position.

7. The bowstring drawing mechanism of claim 6, wherein the drive gear assembly further comprises:

a drive gear operatively coupled to the drive shaft, wherein the rotation of the drive shaft in the first direction causes the rotation of the drive gear in the first direction and the rotation of the drive shaft in the second direction causes the rotation of the drive gear in the second direction;

a spur gear operatively coupled to the pinion shaft, wherein the rotation of the drive gear in the first direction causes the rotation of the spur gear in the second direction; and, the clutch mechanism further comprises a clutch, a spool, and a spring washer, wherein the spool is pinned to the pinion shaft and carries the spur gear, the clutch and the spring washer, the spur gear is positioned between the spring washer and the clutch, and the spring washer urges the spur gear into contact with the clutch, wherein the rotation of the spur gear can cause the rotation of the clutch and the rotation of the clutch can cause the rotation of the spur gear.

8. The bowstring drawing mechanism of claim 6, further comprising:

a housing having a first aperture and a second aperture, wherein the drive shaft can be accessed through the first aperture and the pinion shaft can be accessed through the second aperture.

9. The bowstring drawing mechanism of claim 6, further comprising:

a housing having a first aperture and a second aperture, wherein a first drive head formed at the end of the drive shaft extends through the first aperture and a second drive head formed at the end of the pinion shaft extends through the second aperture.

* * * * *